US010321218B2

(12) United States Patent
Lee

(10) Patent No.: US 10,321,218 B2
(45) Date of Patent: Jun. 11, 2019

(54) EAR DEVICE FOR FIXING EARPHONE

(71) Applicant: Seung Chul Lee, Seo-gu Daegu (KR)

(72) Inventor: Seung Chul Lee, Seo-gu Daegu (KR)

( * ) Notice: Subject to any disclaimer, the term of this patent is extended or adjusted under 35 U.S.C. 154(b) by 0 days.

(21) Appl. No.: 15/575,997

(22) PCT Filed: May 19, 2016

(86) PCT No.: PCT/KR2016/005301
§ 371 (c)(1),
(2) Date: Nov. 21, 2017

(87) PCT Pub. No.: WO2016/190604
PCT Pub. Date: Dec. 1, 2016

(65) Prior Publication Data

US 2018/0160208 A1 Jun. 7, 2018

(30) Foreign Application Priority Data

May 22, 2015 (KR) ..... 10-2015-0071450
Dec. 3, 2015 (KR) ..... 10-2015-0171179
May 18, 2016 (KR) ..... 10-2016-0060517

(51) Int. Cl.
*H04R 1/10* (2006.01)

(52) U.S. Cl.
CPC ..... *H04R 1/105* (2013.01); *H04R 1/1083* (2013.01); *H04R 1/1016* (2013.01); *H04R 2201/107* (2013.01)

(58) Field of Classification Search
CPC .. H04R 25/00; H04R 1/105; H04R 2225/021; H04R 2225/63; H04R 2460/13; H04R 1/1016
(Continued)

(56) References Cited

U.S. PATENT DOCUMENTS 5,210,792 A * 5/1993 Kajihara ..... H04M 1/05 379/430
6,879,699 B1 * 4/2005 Logan ..... H04M 1/05 381/367
(Continued)

FOREIGN PATENT DOCUMENTS

JP 2014-033405 A 2/2014
KR 20-0181932 Y1 5/2000
(Continued)

OTHER PUBLICATIONS

International Search Report dated Oct. 12, 2016, issued in International Application No. PCT/KR2016/005301.

*Primary Examiner* — Suhan Ni
(74) *Attorney, Agent, or Firm* — Kilpatrick Townsend & Stockton LLP

(57) ABSTRACT

The present invention relates to an ear device for fixing an earphone, comprising: a fixing body which is formed in the shape of a C-shaped ring so as to be worn on and fixed to an auricle while surrounding the rear part of the auricle; an earphone module, positioned in a groove in the front part of the auricle, for transferring sound to an ear hole; and a support connector which extends in the shape of a ring that traverses a user's auricle from one portion of the fixing body to the earphone module, the support connector being formed of an elastic body or flexible metal so as to, according to deformation of the support connector, enable the fixing body and the earphone module to be separated from each other or to approach each other so that the fixing body and the earphone module are engaged with and fixed to each other on the auricle. The fixing body has a first coupling member on one side thereof, the earphone module has a second coupling member on one side thereof, and both ends of the support connector are detachably configured so as to be separated from and coupled to the first coupling member and
(Continued)

the second coupling member so that it is possible to use the fixing body and the earphone module by integrally coupling the fixing body and the earphone module, or it is possible to use the earphone module alone according to a user's need. The earphone module further comprises a sound box, a length adjustment unit and an accessory, and the accessory and the fixing body have an electronic chip such as an RFID or authentication key embedded therein. Thus, the present invention has effects of: firmly and stably fixing an earphone to a user's ear with the least number of constitutional elements; pre-empting occurrence of ear pain and hearing impairment since the earphone is not directly inserted into the user's ear hole; and enabling the user to hear ambient sound, thereby enabling the user to rapidly cope with surrounding circumstances and escape from safety accident-related danger.

5 Claims, 9 Drawing Sheets

(58) Field of Classification Search
USPC ..... 381/327, 330, 380–381
See application file for complete search history.

(56) References Cited

U.S. PATENT DOCUMENTS

| | | | | |
|---|---|---|---|---|
| 2004/0066948 | A1* | 4/2004 | Bogeskov-Jensen ... | H04M 1/05 381/376 |
| 2008/0075316 | A1* | 3/2008 | Chan ..... | H04R 1/105 381/381 |
| 2014/0241563 | A1 | 8/2014 | Monahan et al. | |

FOREIGN PATENT DOCUMENTS

| | | | |
|---|---|---|---|
| KR | 20-0356186 | Y1 | 7/2004 |
| KR | 10-1446597 | B1 | 10/2014 |

* cited by examiner

EAR DEVICE FOR FIXING EARPHONE

TECHNICAL FIELD

The present invention relates to an ear device for fixing an earphone, and more particularly, to an ear device for fixing an earphone and capable of being stably fixed to an auricle in a clip manner, of allowing a user to listen to audio of the earphone and to hear ambient sound at the same time, and of minimizing hearing loss.

BACKGROUND ART

In general, earphones are a type of speakers worn on ears of a user to output audio and are used in wired or wireless connection with a multimedia player such as a radio receiver, an MP3 player, a mobile phone, a personal computer, or a laptop.

The user who wears the earphones in ear canals concentrates on audio reproduced by the multimedia player or, mostly, does something else, e.g., working, reading, studying, or exercising, while listening to music.

However, when the user listens to audio by wearing the earphones in the ear canals, ambient sound may not be easily heard and thus the user may not recognize a danger.

Particularly, a user who is exercising, e.g., jogging or hiking, or walking with the earphones in may not hear ambient sound and thus may have an accident due to collision with a vehicle or another pedestrian.

In addition, when the user uses the earphones on a high volume for a long time, a negative influence may be exerted on eardrums and, in worse cases, the eardrums may rupture or hearing loss may be caused.

Typically, ear devices are divided into accessories such as earrings and piercings, and fixtures for fixing earphones to ears of a user.

As an ear device for fixing an earphone to an ear of a user, the present applicant has proposed Patent Document 1. However, the ear device of Patent Document 1 may be easily separated due to violent motion of the user or impact.

In addition, using the ear device of Patent Document 1, parts suitable for various usages of the user should be separately purchased and the earphone may not be easily worn.

Furthermore, a conventional earphone should be pressed and inserted into an ear canal and thus pain and itchiness may be caused by the insertion pressure.

Therefore, the present applicant proposes herein an ear device for fixing an earphone and capable of firmly fixing the earphone to an ear of a user without inserting the earphone into an ear canal, and of allowing the user to hear ambient sound to prevent an accident while listening to audio.

PRIOR ART DOCUMENT

Patent Document (Patent Document 1) KR 10-1544687 B1

DISCLOSURE

Technical Problem

Therefore, the present invention has been made in view of the above problems, and it is one object of the present invention to provide an ear device for fixing an earphone and capable of being stably fixed along an auricle in a clip manner to be stably worn without being separated due to violent motion of a user, of allowing the user to listen to audio of the earphone and to hear ambient sound at the same time to recognize and avoid a peripheral danger, and of reducing a pressure applied to an ear canal to reduce hearing loss.

Technical Solution

In accordance with one aspect of the present invention, provided is an ear device for fixing an earphone, the ear device including a fixing body provided in a 'C'-arc shape to be fitted and fixed to surround a rear part of an auricle, an earphone module located at a recess in front of the auricle to output audio to an ear canal, and a support connector extending in an arc shape to cross the auricle of a user from a part of the fixing body to the earphone module, made of an elastic material or a flexible metal, and transformed to move the fixing body and the earphone module away from or closer to each other so as to be fitted and fixed to the auricle.

Herein, a first coupling hole may be provided at a side of the fixing body and a second coupling hole may be provided at a side of the earphone module, two ends of the support connector may be individually attachable to and detachable from the first and second coupling holes, and thus the earphone module may be usable alone or in combination with the fixing body and the support connector as desired by the user.

The earphone module may further include a sound chamber protruding from the earphone module and inserted into the ear canal to output audio, and a length adjuster provided between the sound chamber and the earphone module and being extensible to adjust a depth by which the sound chamber is inserted into the ear canal. Likewise, the earphone module may further include a microphone extending along a cheek of the user to receive voice of the user.

A sound insulation member may be rotatably provided at a part of the support connector adjacent to a rear part of the earphone module to block or receive ambient sound by covering or uncovering the ear canal as desired by the user, and the support connector may further include an accessory detachably provided on the support connector and having various figures or shapes based on user preferences.

Lastly, the accessory or the fixing body may include an electronic chip having an RFID for public transportation or mobile payment, a door lock authentication key, or the like.

Advantageous Effects

As apparent from the fore-going, the present invention has the following effects.

First, an earphone may be firmly and stably fixed to an ear of a user by using the minimum elements.

Second, ear pain and hearing loss may be prevented because the earphone is not directly inserted into an ear canal of the user, and the user may hear ambient sound and thus rapidly react to a peripheral event, thereby avoiding an accident.

BEST MODE

Hereinafter, the present invention will be described in detail by explaining embodiments of the invention with reference to the attached drawings.

Figure 1:
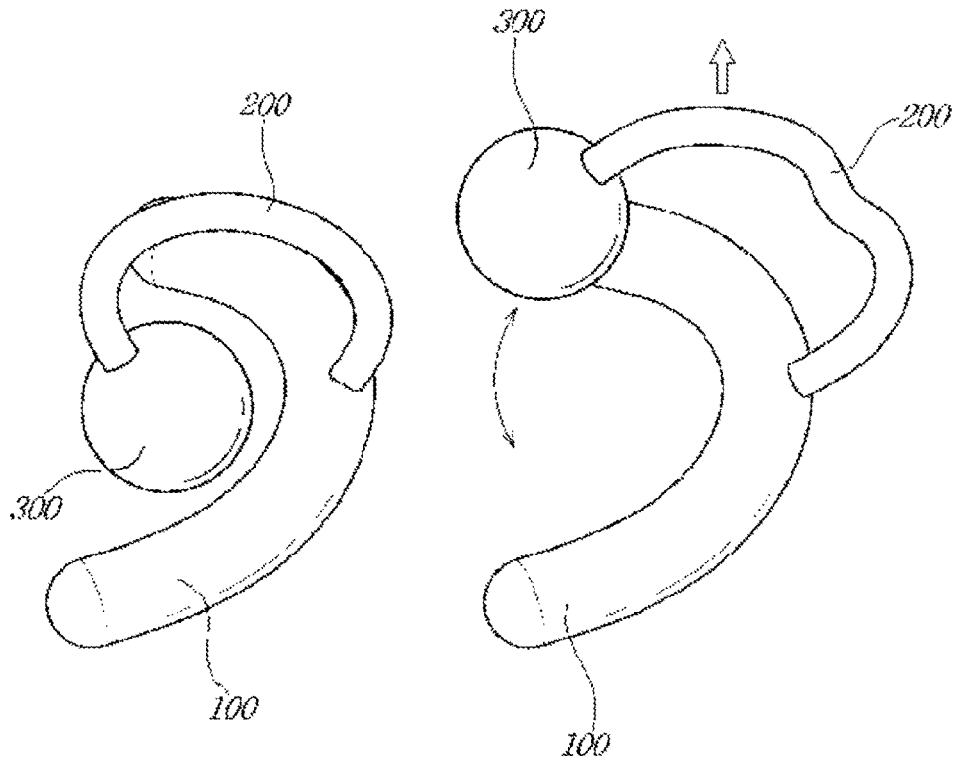
FIG. 1 is a structural view of an ear device for fixing an earphone, according to the present invention.
Figure 2:
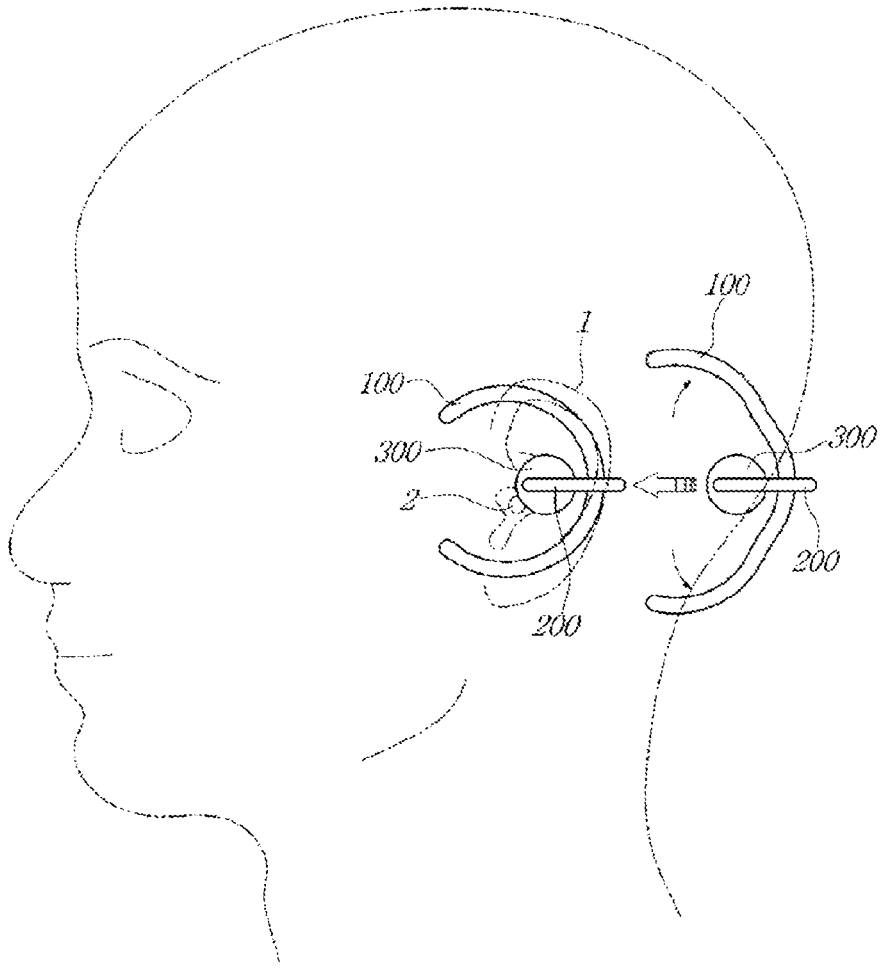
FIG. 2 is an exemplary view showing how to wear the ear device for fixing the earphone, according to the present invention.

As illustrated in FIGS. 1 and 2, an ear device for fixing an earphone, according to the present invention, has a simple structure including a 'C'-shaped fixing body 100 worn to surround a rear part of an auricle 1 of a user, a 'C'-shaped support connector 200 crossing from the fixing body 100 to a front side of the auricle 1, and an earphone module 300 provided at an end of the support connector 200 to output audio.

Herein, the fixing body 100 is provided in a 'C'-arc shape to be fitted and fixed to surround the rear part of the auricle 1 of the user, and may be generally produced using metal or plastic having elasticity.

Preferably, in order to closely contact the rear part of the auricle 1 of the user and to increase wear ability for various sizes of the auricle 1, the fixing body 100 includes a frame made of a freely transformable flexible metal and a cover made of a soft material such as sponge.

In this case, as illustrated in FIG. 2, the fixing body 100 made of an elastic material or a flexible metal may be pulled outward with slight force applied by the user, may be pushed to closely contact the rear part of the auricle 1, and then may be restored elastically or pulled inward to surround the auricle 1.

Therefore, the fixing body 100 surrounds the rear part of the auricle 1, and more accurately, presses upper and lower points of the auricle 1.

Furthermore, the fixing body 100 may prevent vertical movement by surrounding the rear part of the auricle 1, and be firmly fixed by distributing the weight of the whole ear device around the auricle 1.

In this case, depending on purposes desired by the user, various modules such as an audio player, a radio transceiver, an interpreter, a temperature sensor, a pedometer, a vibrator, and a radio-frequency identifier (RFID) may be included in the fixing body 100.

The support connector 200 extends in an arc shape to cross the auricle 1 from a part of the fixing body 100 to a recess in front of the auricle 1 of the user, and is made of an elastic material or a flexible metal like the fixing body 100.

In this case, since an elastic material can lose elastic force and fixing force thereof when used a lot, it is preferable to use a flexible metal.

The flexible metal may be any metal which is freely transformable with slight force applied by the user, e.g., gold, silver, copper, or aluminum. Particularly, aluminum wire which is easily transformable and maintainable in shape is preferable.

Since the fixing body 100 is provided at an end of the support connector 200 and the earphone module 300 is provided at another end thereof, if the two ends of the support connector 200 are pulled outward with slight force applied by the user, the fixing body 100 and the earphone module 300 may be simultaneously separated from each other to position the auricle 1 there between and, if the support connector 200 is restored elastically or pulled inward to an original state thereof, the fixing body 100 and the earphone module 300 move closer to each other to be fitted and fixed to the auricle 1.

In this case, the fixing body 100 surrounds the rear part of the auricle 1 to support the ear device from above and below, the earphone module 300 is located and pressed at the recess in front of the auricle 1 to support the ear device from a side, and thus the ear device is firmly fixed to prevent vertical and horizontal movement by surrounding the auricle 1 and supporting three points.

The earphone module 300 is provided at an end of the support connector 200 and is located at the recess in front of the auricle 1 of the user to output audio to an ear canal 2.

In this case, the earphone module 300 has various functions of a typical earphone, e.g., speaker, battery, Bluetooth, and audio device functions, and specific elements included in the earphone module 300 will not be described herein.

Therefore, the earphone module 300 may employ any of a wireless method using a Bluetooth function and a wired method using connection of an earphone jack.

Eventually, the support connector 200 may be transformed to move the fixing body 100 and the earphone module 300 away from or closer to each other so as to be fitted and fixed to the auricle 1, and thus the ear device for fixing the earphone may be firmly worn on the auricle 1.

Figure 3:
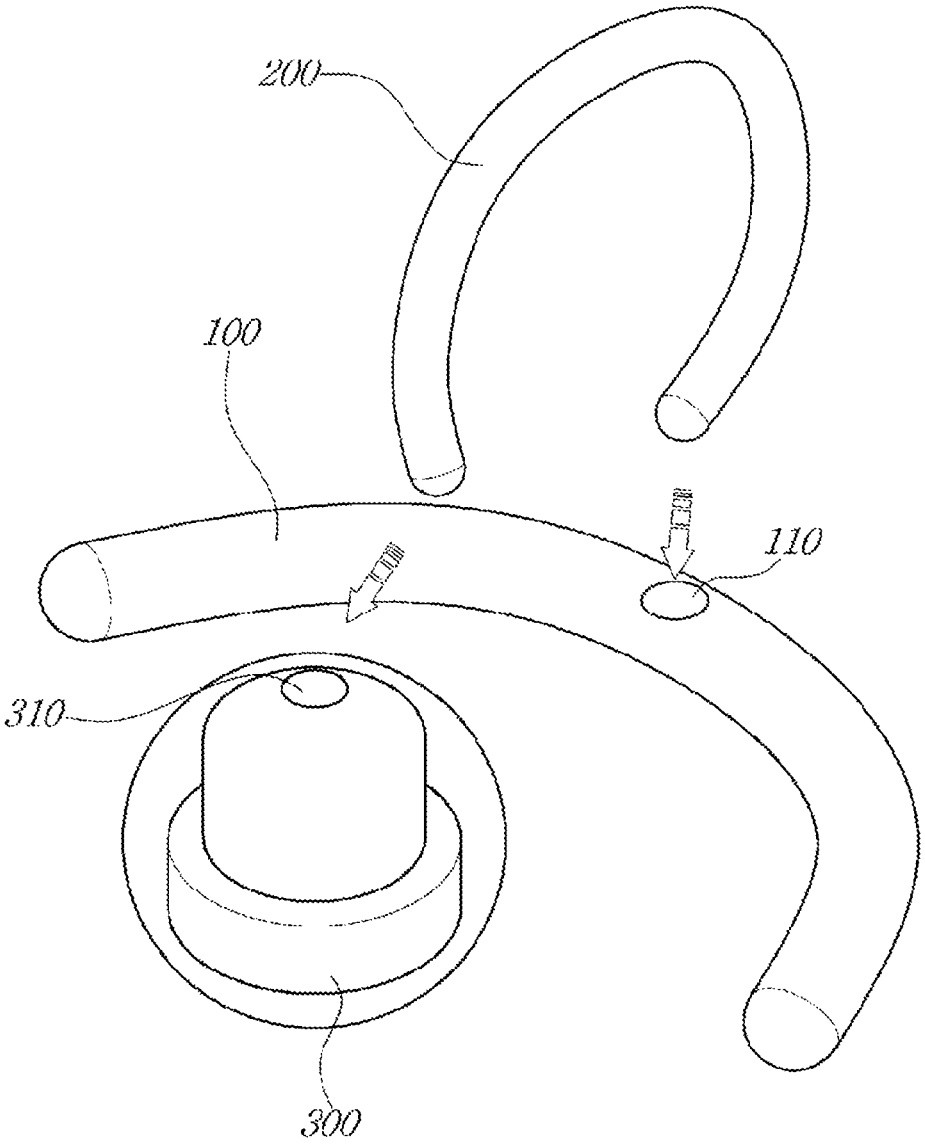
FIG. 3 is an exploded view of the ear device for fixing the earphone, according to the present invention.

As illustrated in FIG. 3, a first coupling hole 110 is provided at a side of the fixing body 100, and a second coupling hole 310 is provided at a side of the earphone module 300.

The two ends of the support connector 200 are individually attachable to and detachable from the first and second coupling holes 110 and 310, and thus the earphone module 300 is usable alone or in combination with the fixing body 100 and the support connector 200 as desired by the user.

That is, when a user violently moves outdoors, e.g., exercises or hikes, to prevent the earphone from being easily separated, the fixing body 100, the earphone module 300, and the support connector 200 may be worn and used in combination as illustrated in FIG. 2. Otherwise, both of the fixing body 100 and the support connector 200 may be detached in such a manner that another user may use the earphone module 300 alone by wearing the same in the ear canal 2 like a typical earphone.

The structure and various usages of the ear device of the present invention will now be described in detail by explaining embodiments thereof.

First Embodiment

Figure 4:
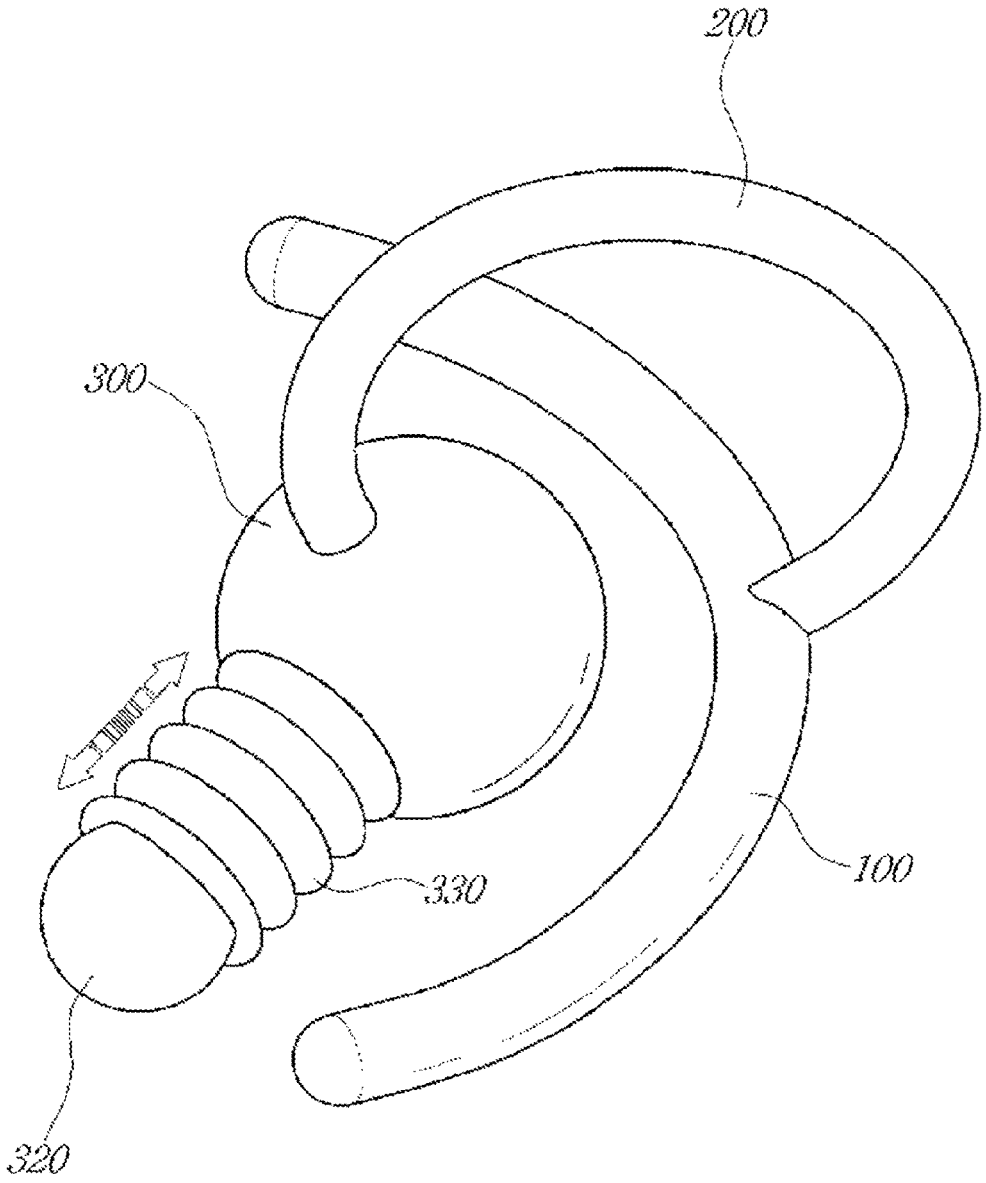
FIG. 4 is a structural view of a first embodiment of the ear device for fixing the earphone, according to the present invention.

Referring to FIG. 4, the earphone module 300 further includes a sound chamber 320 protruding from the earphone module 300 and inserted into the ear canal 2 to output audio, and a length adjuster 330 provided between the sound chamber 320 and the earphone module 300 and being length-adjustable to adjust a depth by which the sound chamber 320 is inserted into the ear canal 2.

That is, the sound chamber 320 is further provided at a side of the earphone module 300 toward the ear canal 2 of the user such that audio may be output more closely to the user.

In addition, the length adjuster 330 is further provided between the sound chamber 320 and the earphone module 300 such that the sound chamber 320 may extend from the earphone module 300 and, when the sound chamber 320 is inserted into the ear canal 2 as necessary, the length adjuster 330 may softly contact the inner wall of the ear canal 2 and thus ear pain caused by a conventional earphone may be reduced.

Second Embodiment

Figure 5:
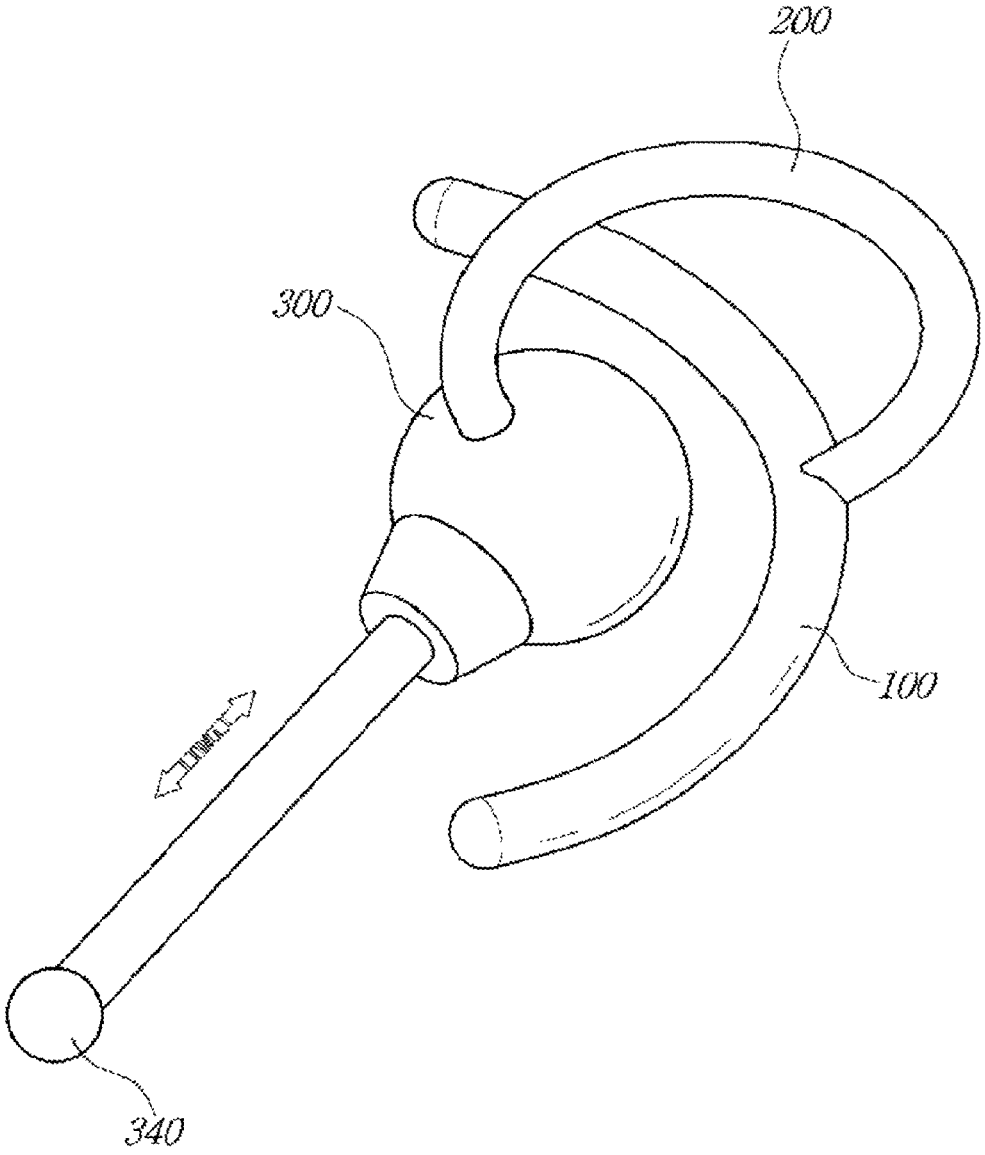
FIG. 5 is a structural view of a second embodiment of the ear device for fixing the earphone, according to the present invention.

Referring to FIG. 5, the earphone module 300 further includes a microphone 340 extending along a cheek of the user to receive voice of the user.

The microphone 340 is further provided to use the earphone module 300 as a typical headset.

Preferably, the microphone 340 is provided in a telescopic manner thus extends stepwise as desired by the user. As such, voice of the user may be more clearly received based on reception sensitivity of the microphone 340 or an ambient environment.

Third Embodiment

Figure 6:
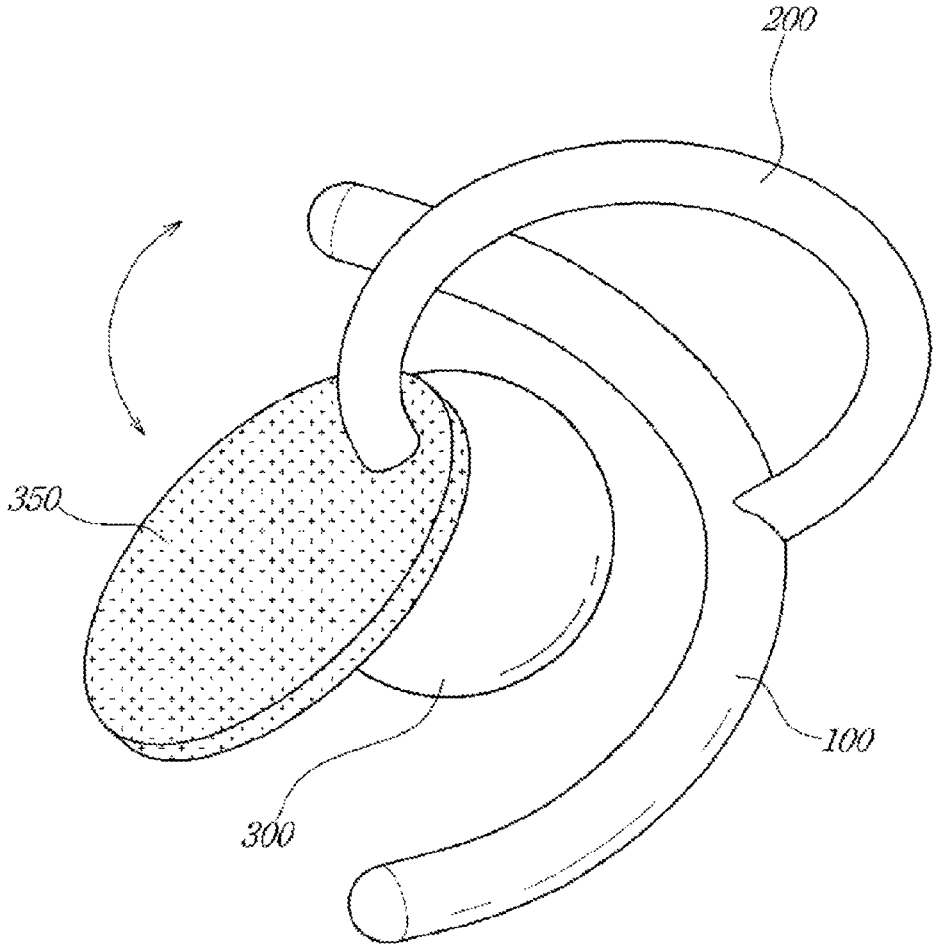
FIG. 6 is a structural view of a third embodiment of the ear device for fixing the earphone, according to the present invention.

Referring to FIG. 6, a sound insulation member 350 rotatable about the support connector 200 may be provided at a part of the support connector 200 adjacent to a rear part of the earphone module 300 to block ambient sound by covering the ear canal 2 as desired by the user.

That is, after the ear device is worn on the auricle 1 of the user based on transformation of the support connector 200 and the fixing body 100, if the sound insulation member 350 rotates toward the support connector 200 to open the ear canal 2, the user may listen to audio and hear ambient sound at the same time.

Otherwise, if the sound insulation member 350 rotates toward the earphone module 300 to close the ear canal 2, ambient sound may be blocked and thus the user may concentrate on listening to audio.

Alternatively, the sound insulation member 350 may serve as an earplug to block both of earphone sound and ambient sound and thus the user may concentrate on studying or working.

In this case, preferably, the sound insulation member 350 is made of a typical sponge or silicone material and is provided in a seashell or fan shape to cover the ear canal 2.

Fourth Embodiment

Figure 7:
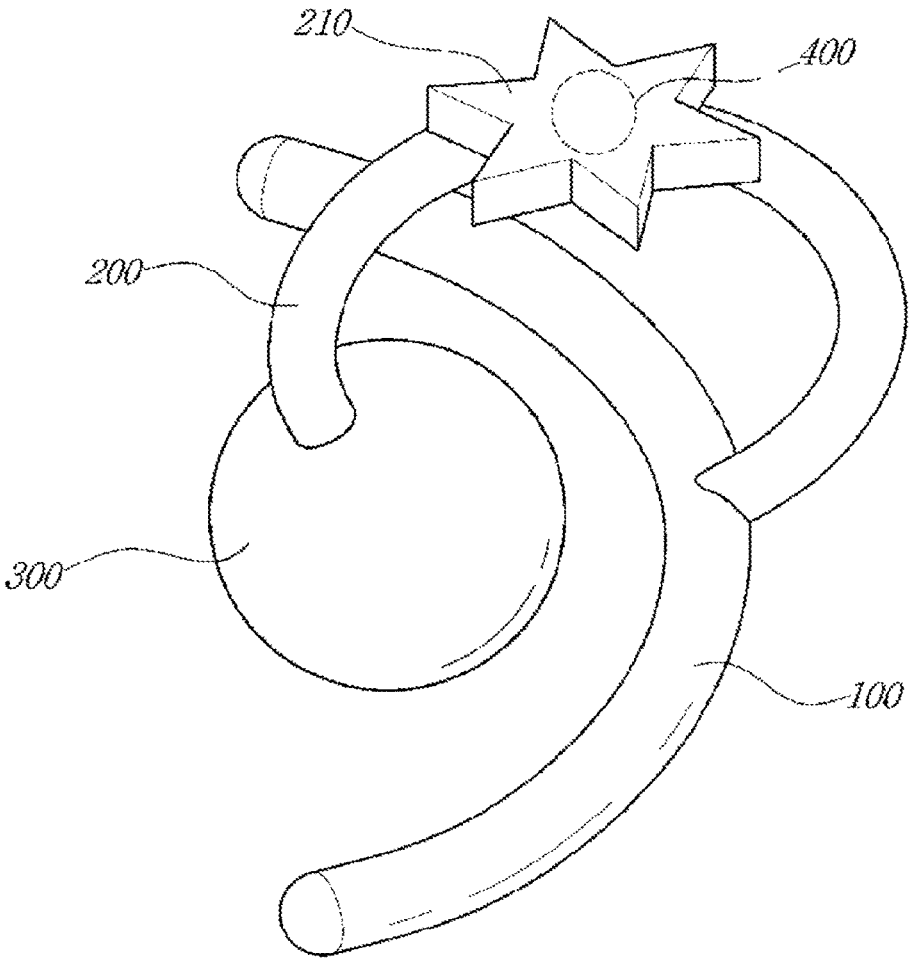
FIG. 7 is a structural view of a fourth embodiment of the ear device for fixing the earphone, according to the present invention.

Referring to FIG. 7, the support connector 200 further includes an accessory 210 detachably or integrally provided on the support connector 200 and having various figures or shapes based on user preferences.

As such, a variety of cute or pretty accessories 210 may be provided for female users who use the ear device of the present invention.

The accessory 210 may include an electronic chip 400 having an RFID for public transportation or mobile payment, a door lock authentication key, or the like.

That is, instead of inconveniently taking a tag card having the electronic chip 400 out of a pocket or wallet, the user may easily detach the accessory 210 from the worn ear device of the present invention, tap the accessory 210 on an RFID reader to use public transportation or receive door lock authentication, and then attach the accessory 210 back to the ear device.

Fifth Embodiment

Figure 8:
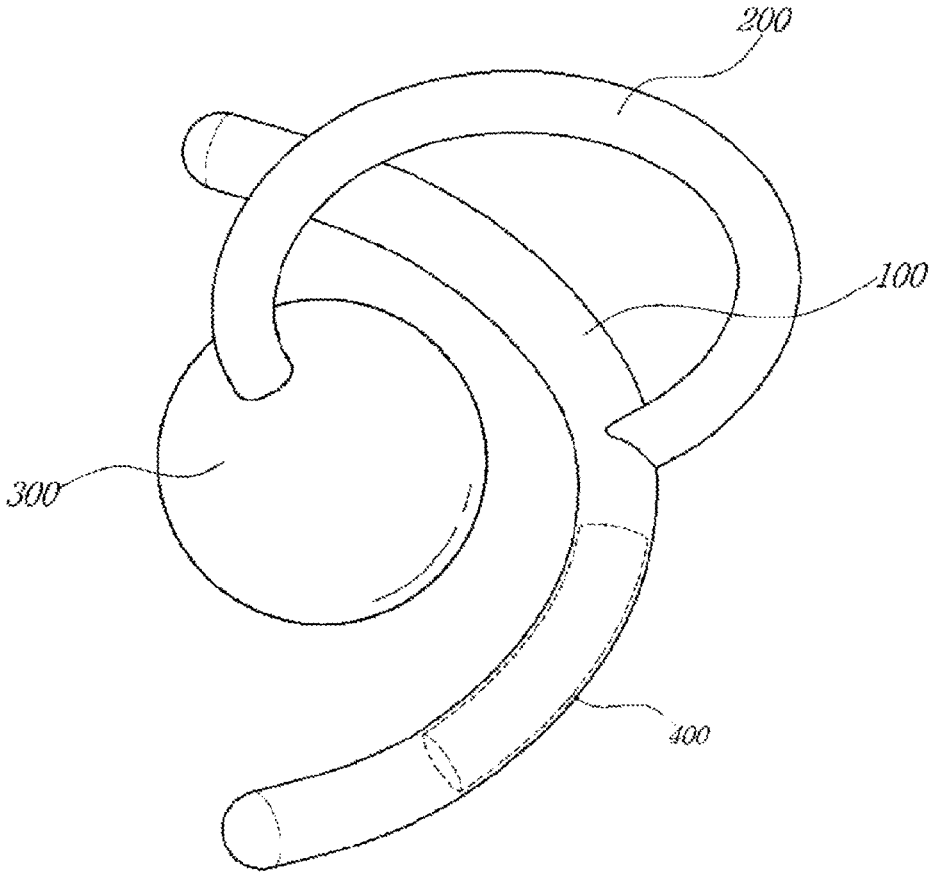
FIG. 8 is a structural view of a fifth embodiment of the ear device for fixing the earphone, according to the present invention.

Referring to FIG. 8, similarly to the fourth embodiment, the fixing body 100 may include an electronic chip 400 having an RFID for public transportation or mobile payment, a door lock authentication key, or the like.

That is, instead of inconveniently taking a tag card having the electronic chip 400 out of a pocket or wallet, the user may easily take off the worn ear device of the present invention, tap the ear device on an RFID reader to use public transportation, and then wear the ear device again.

Figure 9:
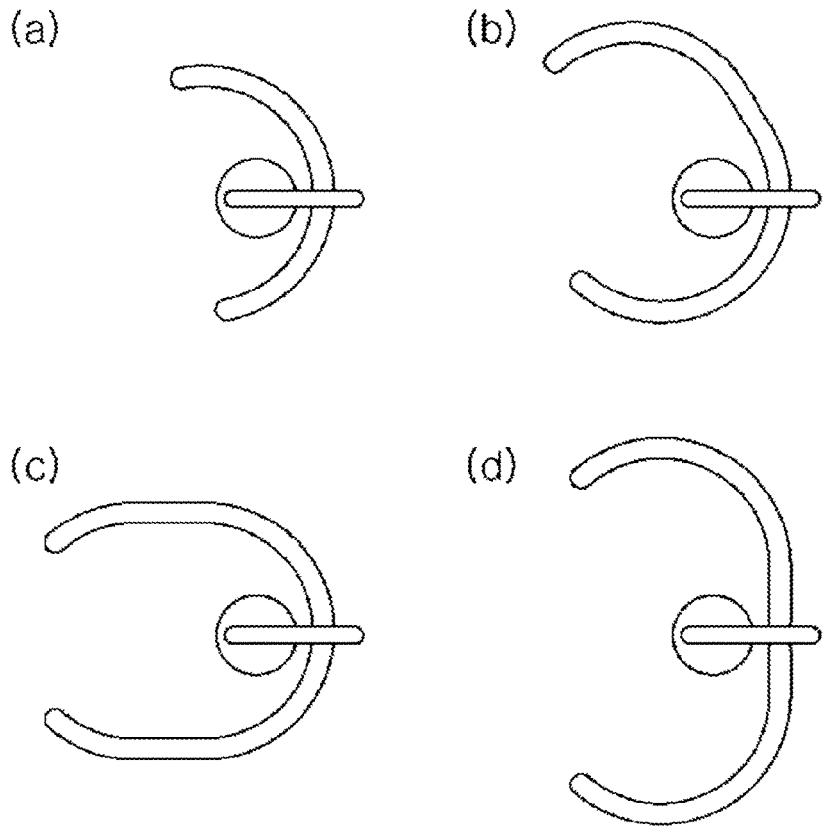
FIG. 9 is an exemplary view showing various modifications of a fixing body of the ear device for fixing the earphone, according to the present invention.

Lastly, referring to FIG. 9, preferably, the fixing body 100 is produced in various lengths, shapes, and sizes to be applicable to various users who wear the ear device of the present invention, i.e., various sizes and shapes of the auricle 1, so as to be selected based on an ear shape of each user.

Using the above-described ear device of the present invention, an earphone may be firmly and stably fixed to an ear of a user by using the minimum elements, ear pain and hearing loss may be prevented because the earphone is not directly inserted into the ear canal 2 of the user, and the user may hear ambient sound and thus rapidly react to a peripheral event, thereby avoiding an accident.

The terms used in the specification and the claims should not be limited to conventional or lexical meanings and should be construed as having meanings and concepts corresponding to the technical idea of the present invention in order to the most appropriately describe the present invention.

While the present invention has been particularly shown and described with reference to embodiments thereof, it will be understood by one of ordinary skill in the art that various changes in form and details may be made therein without departing from the spirit and scope of the present invention as defined by the following claims.

EXPLANATION OF REFERENCE NUMERALS

1: Auricle
2: Ear canal
100: Fixing body
110: First coupling hole
200: Support connector
210: Accessory
300: Earphone module
310: Second coupling hole
320: Sound chamber
330: Length adjuster
340: Microphone
350: Sound insulation member
400: Electronic chip

The invention claimed is:

1. An ear device for fixing an earphone, the ear device comprising:

a fixing body 100 provided in a 'C'-arc shape to be fitted and fixed to surround a rear part of an auricle 1;

an earphone module 300 located at a recess in front of the auricle 1 to output audio to a near canal 2; and a support connector 200 extending in an arc shape to cross the auricle 1 of a user from a part of the fixing body 100 to the earphone module 300, made of an elastic material or a flexible metal, and transformed to move the fixing body 100 and the earphone module 300 away from or closer to each other so as to be fitted and fixed to the auricle 1, the fixing body 100 is provided at an end of the support connector 200 and the earphone module 300 is provided at another end thereof, when two ends of the support connector 200 are pulled outward with slight force applied, the fixing body 100 and the earphone module 300 is simultaneously separated from each other to position the auricle 1 therebetween and, when the support connector 200 is restored elastically or pulled inward to an original state thereof, the fixing body 100 and the earphone module 300 move closer to each other to be fitted and fixed to the auricle 1.

2. The ear device according to claim 1, wherein a first coupling hole 110 is provided at a side of the fixing body 100 and a second coupling hole 310 is provided at a side of the earphone module 300, two ends of the support connector 200 are individually been attachable to and detachable from the first and second coupling holes 110 and 310, and thus the earphone module 300 is been usable alone or in combination with the fixing body 100 and the support connector 200 as desired by the user.

3. The ear device according to claim 1, wherein the earphone module 300 further comprises:

a sound chamber 320 protruding from the earphone module 300 and inserted into the ear canal 2 to output audio; and a length adjuster 330 provided between the sound chamber 320 and the earphone module 300 and being length-adjustable to adjust a depth by which the sound chamber 320 is inserted into the ear canal 2.

4. The ear device according to claim 1, wherein the earphone module 300 further comprises a microphone 340 for receiving voice of the user.

5. The ear device according to claim 1, wherein a sound insulation member 350 which is rotatable about the support connector 200 is provided at a part of the support connector 200 adjacent to a rear part of the earphone module 300 to block ambient sound by covering the ear canal 2 as desired by the user.

* * * * *